US012122016B2

(12) United States Patent
Sugita

(10) Patent No.: US 12,122,016 B2
(45) Date of Patent: Oct. 22, 2024

(54) GRINDING HEAD AND BRUSH RING FOR LONG ROD GRINDING MACHINE

(71) Applicant: MAKITA CORPORATION, Anjo (JP)

(72) Inventor: Fumihide Sugita, Anjo (JP)

(73) Assignee: MAKITA CORPORATION, Anjo (JP)

( * ) Notice: Subject to any disclaimer, the term of this patent is extended or adjusted under 35 U.S.C. 154(b) by 300 days.

(21) Appl. No.: 17/666,773

(22) Filed: Feb. 8, 2022

(65) Prior Publication Data

US 2022/0281067 A1 Sep. 8, 2022

(30) Foreign Application Priority Data

Mar. 2, 2021 (JP) ..... 2021-032853

(51) Int. Cl.
*B24B 55/10* (2006.01)
*B24B 23/02* (2006.01)

(52) U.S. Cl.
CPC ..... *B24B 55/102* (2013.01); *B24B 23/02* (2013.01)

(58) Field of Classification Search
CPC .... B24B 5/00; B24B 5/35; B24B 7/00; B24B 7/005; B24B 7/182; B24B 7/184; B24B 7/186; B24B 23/02; B24B 41/002; B24B 41/04; B24B 55/052; B24B 55/102; B24B 55/12; B24B 55/10; B24B 55/105; B24B 55/04; B24B 55/05
See application file for complete search history.

(56) References Cited

U.S. PATENT DOCUMENTS

2018/0326555 A1* 11/2018 Moller ..... B24B 55/052
2021/0121999 A1* 4/2021 Droste ..... B24B 7/184

FOREIGN PATENT DOCUMENTS

EP 2 202 029 A2 6/2010
WO WO-2019145559 A1 * 8/2019 ..... B24B 23/028

* cited by examiner

*Primary Examiner* — Eric J Rosen
*Assistant Examiner* — John C Merino
(74) *Attorney, Agent, or Firm* — Oliff PLC

(57) ABSTRACT

A long rod grinding machine reduces the likelihood of dust escaping and falling. The long rod grinding machine includes a head and a rod having an end connected to the head and extending in a front-rear direction. The head includes an electric motor, a pad movable with a driving force from the electric motor, a vertical wall surrounding a radially outer edge of the pad, and a contact member located between the vertical wall and the pad and surrounding the radially outer edge of the pad. The contact member includes a brush holder having one or more through-holes extending in a radial direction of the pad, and a brush located below the brush holder and having a lower end located downward from a lower end of the vertical wall.

18 Claims, 12 Drawing Sheets

UP
DOWN
182
182
182
182
H1
H1
186
H1
H1
H1

GRINDING HEAD AND BRUSH RING FOR LONG ROD GRINDING MACHINE

CROSS-REFERENCE TO RELATED APPLICATIONS

This application claims the benefit of priority to Japanese Patent Application No. 2021-032853, filed on Mar. 2, 2021, the entire contents of which are hereby incorporated by reference.

BACKGROUND

1. Technical Field

The present disclosure relates to a long rod grinding machine (elongated rod grinding machine) such as a drywall sander, a long rod polisher, a long rod grinder, and a long rod concrete plane.

2. Description of the Background

A known tool holder head for a handheld grinding machine is described in European Patent No. 2202029.

A tool holder head 10 includes a disk device 12, a housing 14, and a brush device 58 with a contact surface 60 that comes in contact with a target surface. The brush device 58 is shaped in a brush ring or a lip ring. The disk device 12 elastically supports the brush device 58 with spring elements 68 forming multiple spring strips 70. The brush device 58, which surrounds a tool holder device 22 and a tool connected to the tool holder device 22, comes in contact with a target surface to tightly cover the surface and the tool laterally, allowing proper suction of dust.

BRIEF SUMMARY

The tool holder head 10 may accumulate dust that cannot be sucked, specifically during grinding of a wall surface, inside a lower portion of the brush device 58 and inside a lower side portion 18 of the housing 14. In this case, accumulating dust may escape outside during a grinding operation or may fall when the brush device 58 is removed from a wall surface. Dust that has escaped or fallen contaminates the surroundings. Such dust is then to be removed by cleaning.

One or more aspects of the present disclosure are directed to a long rod grinding machine that reduces the likelihood of dust escaping and falling.

A first aspect of the present disclosure provides a long rod grinding machine, including:

- a head including
  - an electric motor,
  - a pad movable with a driving force from the electric motor,
  - a vertical wall surrounding a radially outer edge of the pad, and
  - a contact member between the vertical wall and the pad, the contact member surrounding the radially outer edge of the pad, the contact member including
    - a brush holder having one or more through-holes extending in a radial direction of the pad, and
    - a brush below the brush holder, the brush having a lower end located downward from a lower end of the vertical wall; and
- a rod having an end connected to the head, the rod extending in a front-rear direction.

The long rod grinding machine according to the above aspect of the present disclosure reduces the likelihood of dust escaping and falling.

DETAILED DESCRIPTION

Embodiments and modifications of the present disclosure will now be described with reference to the drawings as appropriate.

A long rod grinding machine (elongated rod grinding machine) according to the embodiments is a drywall sander 1.

The directional terms such as front, rear, up, down, right, and left in the embodiments and the modifications are defined for ease of explanation, and may be changed depending on, for example, at least the operating situations or the status of a movable member.

The present disclosure is not limited to the embodiments and the modifications.

First Embodiment

Figure 1:
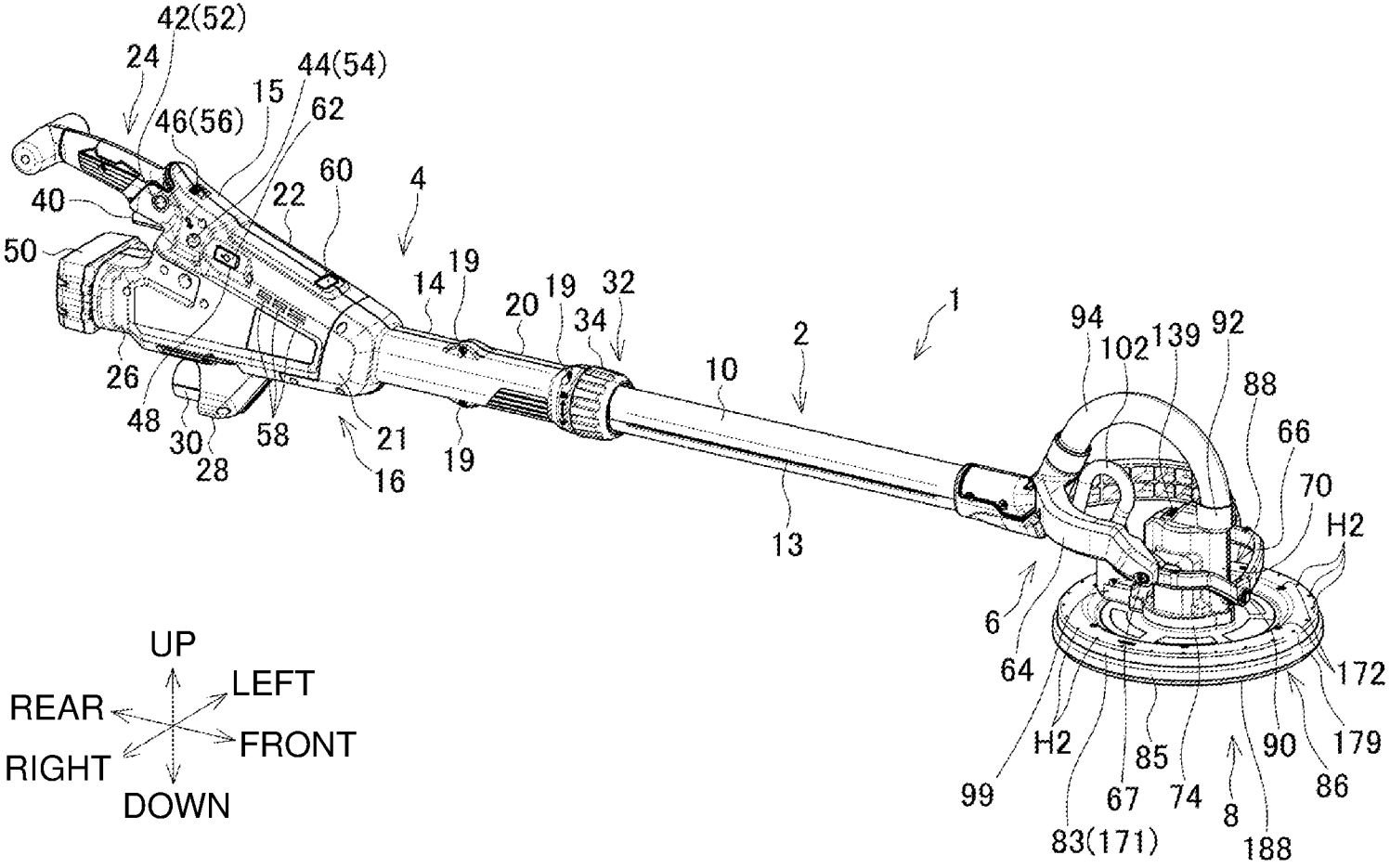
FIG. 1 is a perspective view of a drywall sander according to a first embodiment.

FIG. 1 is a perspective view of the drywall sander 1 according to a first embodiment.

The drywall sander 1 includes a rod 2, a handle 4, a suspension frame unit 6, and a head 8.

The rod 2 extends in the front-rear direction.

The rod 2 includes a larger-diameter pipe 10 as a first rod and a smaller-diameter pipe 12 as a second rod. With the larger-diameter pipe 10 and the smaller-diameter pipe 12 slidable relative to each other, the rod 2 is telescopically extendable and retractable.

The larger-diameter pipe 10 is a double-hollow pipe including a first hollow and a second hollow. The larger-diameter pipe 10 is formed by extrusion molding of an aluminum material. The first hollow is cylindrical. The smaller-diameter pipe 12 extends in the first hollow. The second hollow has a U-shaped cross section along a lower portion of the smaller-diameter pipe 12. The larger-diameter pipe 10 has, on its outer surface, or more specifically, in portions adjacent to a partition separating the first hollow from the second hollow, a pair of left and right larger-diameter pipe guide grooves 13. The larger-diameter pipe guide grooves 13 extend in the front-rear direction. The larger-diameter pipe guide grooves 13 guide the larger-diameter pipe 10 sliding in the front-rear direction. The larger-diameter pipe guide grooves 13 position the larger-diameter pipe 10 in the vertical and lateral directions.

The smaller-diameter pipe 12 is received in the larger-diameter pipe 10 in a slidable manner. The smaller-diameter pipe 12 is cylindrical. The smaller-diameter pipe 12 is attached to a front handle housing 14 and a rear handle housing 15, which define an outer wall of the handle 4. The front handle housing 14 and the rear handle housing 15 together form a handle housing 16.

Figure 2:
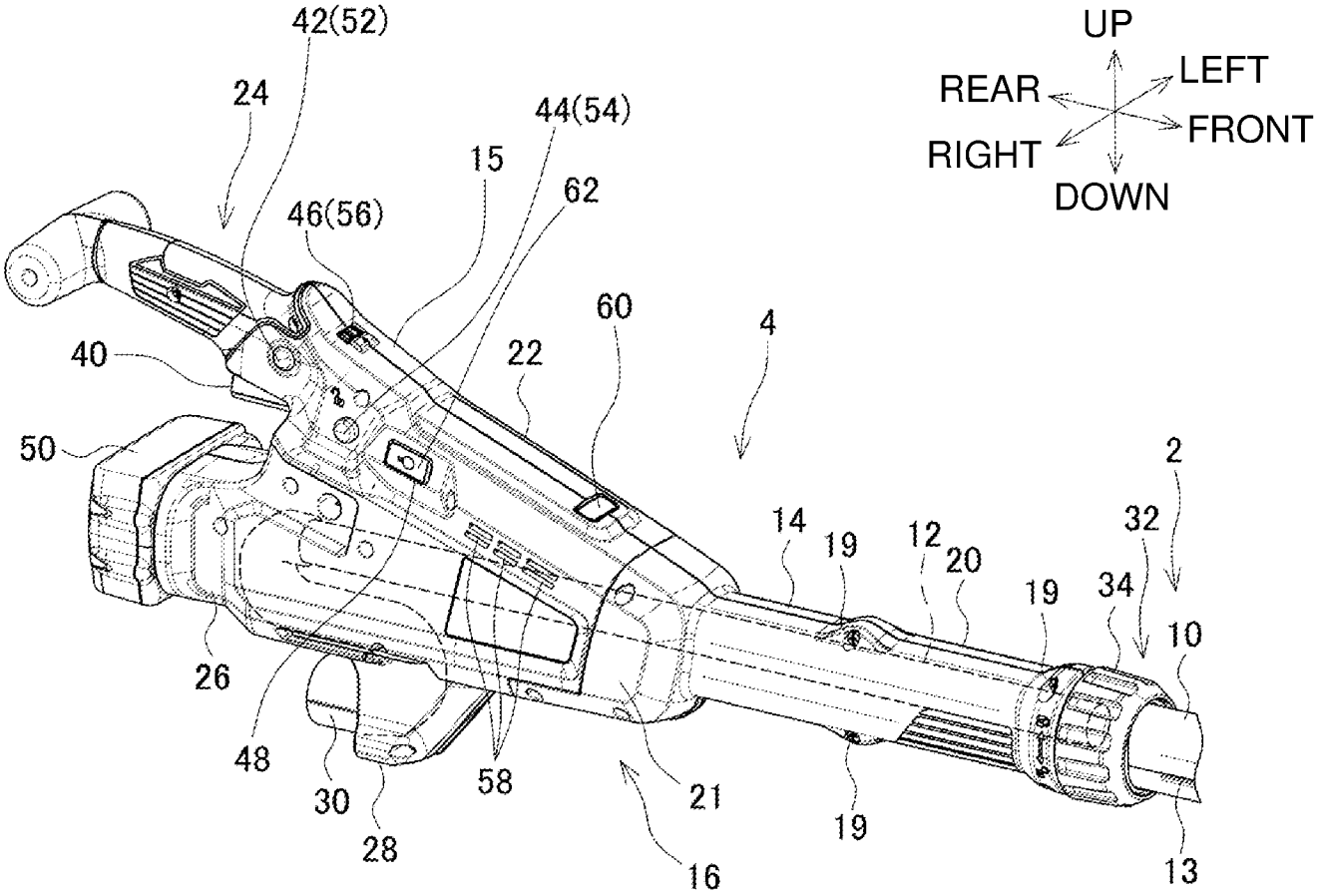
FIG. 2 is a perspective view of a rear portion of the drywall sander in FIG. 1.

FIG. 2 is a perspective view of a rear portion of the drywall sander 1.

The rear handle housing 15 includes left and right halves. The rear handle housing 15 includes a left rear handle housing and a right rear handle housing. The left rear handle housing and the right rear handle housing are joined with each other and fastened with screws (not shown) laterally.

The front handle housing 14 includes left and right halves. The front handle housing 14 includes a left front handle housing and a right front handle housing. The left front handle housing and the right front handle housing are joined with each other and fastened with screws 19 laterally. The front handle housing 14 has a rear end in the shape of a bowl enlarged from its cylindrical front portion. The rear end of the front handle housing 14 receives the front end of the rear handle housing 15. The front handle housing 14 is attached to the rear handle housing 15.

The front handle housing 14 includes a front rod housing 20. The front rod housing 20 extends in the front-rear direction and houses the rod 2.

The rear handle housing 15 includes a rear rod housing 21, a grip base 22, a grip 24, a battery mount 26, and a joint holder 28. The rear rod housing 21 extends in the front-rear direction and houses the rod 2. The grip base 22 is raised and located upward from the rear rod housing 21. The grip 24 is T-shaped as viewed from above and protrudes rearward from a rear upper portion of the grip base 22. The battery mount 26 is located rearward from the rear rod housing 21. The joint holder 28 protrudes downward from the lower middle of the rear rod housing 21 and flares rearward. The joint holder 28 is located downward and frontward from the battery mount 26.

The joint holder 28 holds a joint 30 (dust collector connector). The joint 30 is formed from plastic, is cylindrical, and has an S-shaped space as viewed laterally. The joint 30 is located between the rear rod housing 21 and the battery mount 26 and extends to the joint holder 28. The joint 30 has its upper end being open frontward and connecting to the rear end of the smaller-diameter pipe 12. The joint 30 has its lower end being open rearward and connectable to a dust collecting hose of a dust collector (not shown) (dust collecting hose connector or dust collector connector).

The front rod housing 20 is cylindrical and protrudes frontward from the front end of the rear handle housing 15.

The front rod housing 20 has its front end surrounded by a pipe fastener 32. The pipe fastener 32 includes an outer cylinder 34. The outer cylinder 34 is rotatable about the axis in the front-rear direction relative to the front end of the front rod housing 20 to be movable back and forth.

In response to a user rotating the outer cylinder 34 in a direction for moving forward, the pipe fastener 32 reduces contact pressure on the larger-diameter pipe 10. This allows the larger-diameter pipe 10 to be movable in the front-rear direction relative to the smaller-diameter pipe 12. The length of the rod 2 is thus changeable. With the rod 2 having an intended length, the user rotates the outer cylinder 34 in a direction for the outer cylinder 34 to move backward. This causes the pipe fastener 32 to fasten the larger-diameter pipe 10 under contact pressure. In this manner, the pipe fastener 32 can fasten the rod 2 at any extended or retracted position.

The handle 4 is located at the rear (second end) of the rod 2.

The handle 4 includes the front handle housing 14, the rear handle housing 15, the joint 30, the pipe fastener 32, a trigger 40, a locking member 42, a trigger locking member 44, a speed adjustment dial 46, and a wireless communication adapter socket 48.

The battery mount 26 in the rear handle housing 15 can receive a battery 50 as a power supply. The battery 50 is rectangular parallelepiped (a rectangular prism) and is rechargeable with a charger (not shown). The battery 50 is a battery for power tools.

With its longest side extending laterally, the battery 50 is slid rightward from the left of the battery mount 26 to be attached to the battery mount 26.

A battery button (not shown) is slid rearward to disengage the attached battery 50 from the battery mount 26. The battery 50 is then slid leftward for detachment.

The battery 50 is a versatile 18-volt lithium-ion battery, which can be used in any other tool including a long rod grinding machine. At least any of the shape, the voltage, the type, the number of terminals, and the attaching (detaching) direction of the battery 50 may be modified from those described above.

The trigger 40 extends in the front-rear direction and is located below a switch (not shown). The trigger 40 has a rear portion exposed. The trigger 40 has its middle portion in the front-rear direction supported in a manner swingable relative to the rear handle housing 15. The trigger 40 is pulled upward to turn on the switch.

The locking member 42 is located above the trigger 40.

The locking member 42 extends laterally. The locking member 42 has its left and right ends exposed as locking buttons 52.

The user presses either the left or right locking button 52 while holding the trigger 40 pulled to move the locking member 42, which then engages with the middle portion of the trigger 40. This prevents the trigger 40 released from the pull from returning downward, maintaining the trigger 40 in the pulled state. With the locking button 52 turned on, the switch adjacent to the trigger 40 remains turned on. In response to the user pulling the trigger 40 further upward, the locking member 42 returns to its original position, releasing the trigger 40 from remaining pulled. This releases the switch from remaining turned on.

The trigger locking member 44 is located in front of the trigger 40.

The trigger locking member 44 extends laterally. The trigger locking member 44 has its left and right ends exposed as trigger locking buttons 54.

The user presses the left trigger locking button 54 without pulling the trigger 40 to cause the trigger locking member 44 to engage with the front end of the trigger 40. The trigger locking member 44 thus prevents upward movement of the rear (downward movement of the front) of the trigger 40. The trigger 40 is thus restricted from being pulled. In response to the user pressing the right trigger locking button 54, the trigger locking button 54 that has returned leftward releases the restriction on pulling the trigger 40.

The speed adjustment dial 46 is held in an upper portion of the grip base 22.

The speed adjustment dial 46 includes a disk-shaped dial 56. An upper portion of the curved surface of the dial 56 is exposed upward.

The user rotates the dial 56 to change the switching state of the speed adjustment dial 46. The switching state of the speed adjustment dial 46 corresponds to a speed setting.

The rear handle housing 15 has air vents 58 (air vents) as slits on its right and left side surfaces. Each air vent 58 slopes upward to the rear along the upper surface of the grip base 22. The air vents 58 are arranged vertically in the front-rear direction.

A controller (control circuit board, not shown) is located inward from the air vents 58.

The controller is held in a front portion of the grip base 22.

The controller is electrically connected to the battery mount 26, the switch adjacent to the trigger 40, and the speed adjustment dial 46 with lead wires (not shown).

The controller includes a display 60. The display 60 includes four light-emitting diodes (LEDs) in its upper portion, which is exposed from the upper surface of the rear handle housing 15. The controller displays, on the display 60, whether the motor load is high or low.

A rod lead wire (not shown) extending to the head 8 is connected to the controller. The rod lead wire is a bundle of single lead wires. One of the single lead wires (control lead wire) is connected to the controller. Another one of the single lead wires (power lead wire) is connected to the battery mount 26 (terminal). In other words, the rod lead wire is connected to the handle 4. The rod lead wire is located in the larger-diameter pipe 10 (lead wire accommodating space).

The grip base 22 includes the wireless communication adapter socket 48. The wireless communication adapter socket 48 receives a wireless communication adapter 62.

The wireless communication adapter socket 48 is recessed inward in a box shape from the right outer surface of the rear handle housing 15. The wireless communication adapter 62 received in the wireless communication adapter socket 48 is electrically connected to a wireless communication controller (not shown) in the controller.

The wireless communication adapter 62 wirelessly communicates with an attachment, or the dust collector described above. The dust collector communicating wirelessly can be activated or deactivated in cooperation with a start or stop operation of the drywall sander 1.

The wireless communication adapter 62 and a dust collector wireless communication adapter included in the dust collector are initially linked (paired) to allow wireless communication between them. The pairing is performed by the user pressing a button on the dust collector wireless communication adapter and operating a button (not shown) on the wireless communication adapter 62 within a predetermined period.

Once the pairing is complete, the drywall sander 1 is activated in response to the switch adjacent to the trigger 40 being turned on. Activation information indicating the activation of the drywall sander 1 is transmitted from the wireless communication adapter 62 to the dust collector. In response to the dust collector wireless communication adapter receiving the activation information, the dust collector is activated automatically. Information about the wireless communication state is provided to the user with the lighting state of an adapter lamp in the wireless communication adapter 62.

Figure 3:
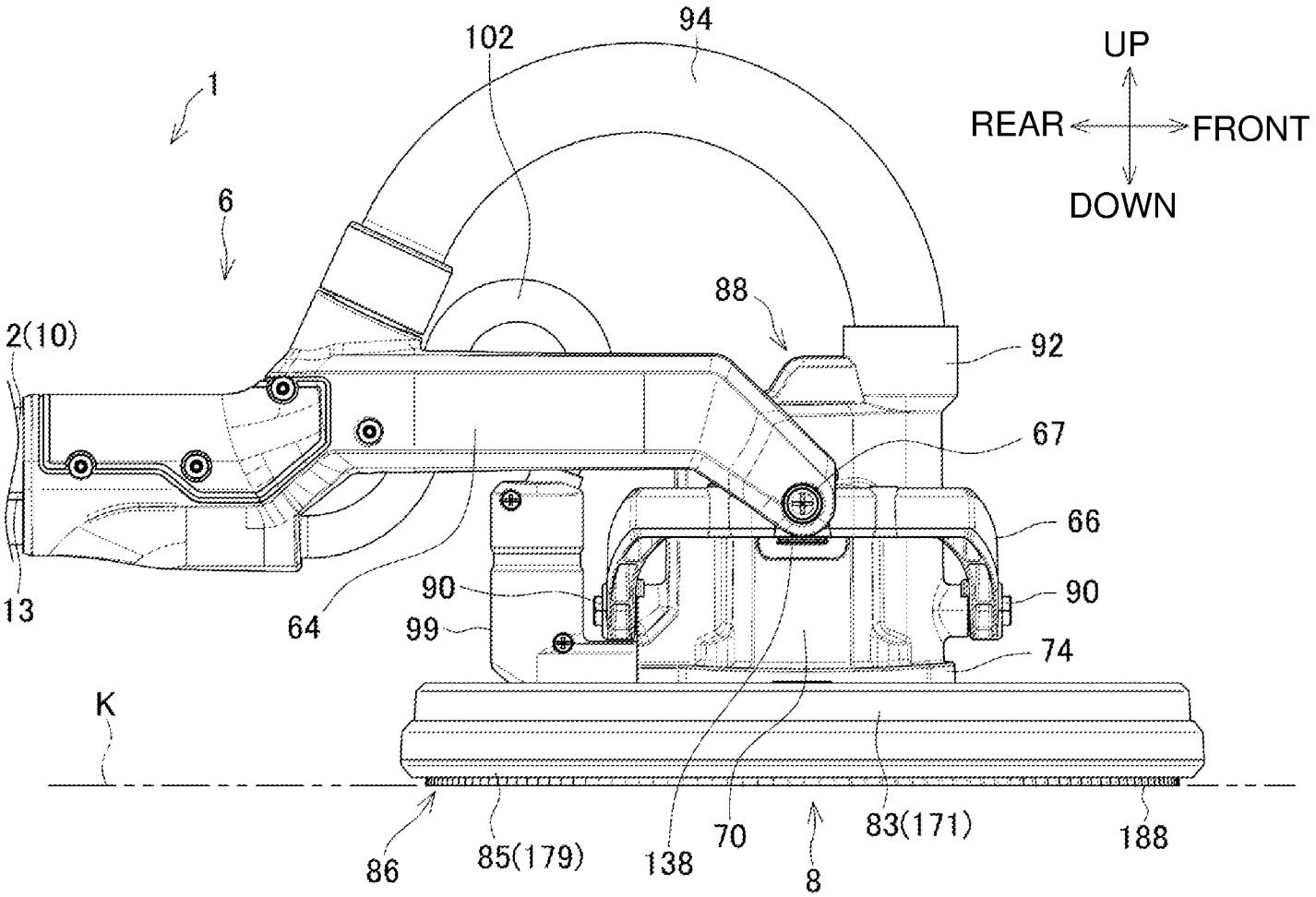
FIG. 3 is a right side view of a front portion of the drywall sander in FIG. 1.
Figure 4:
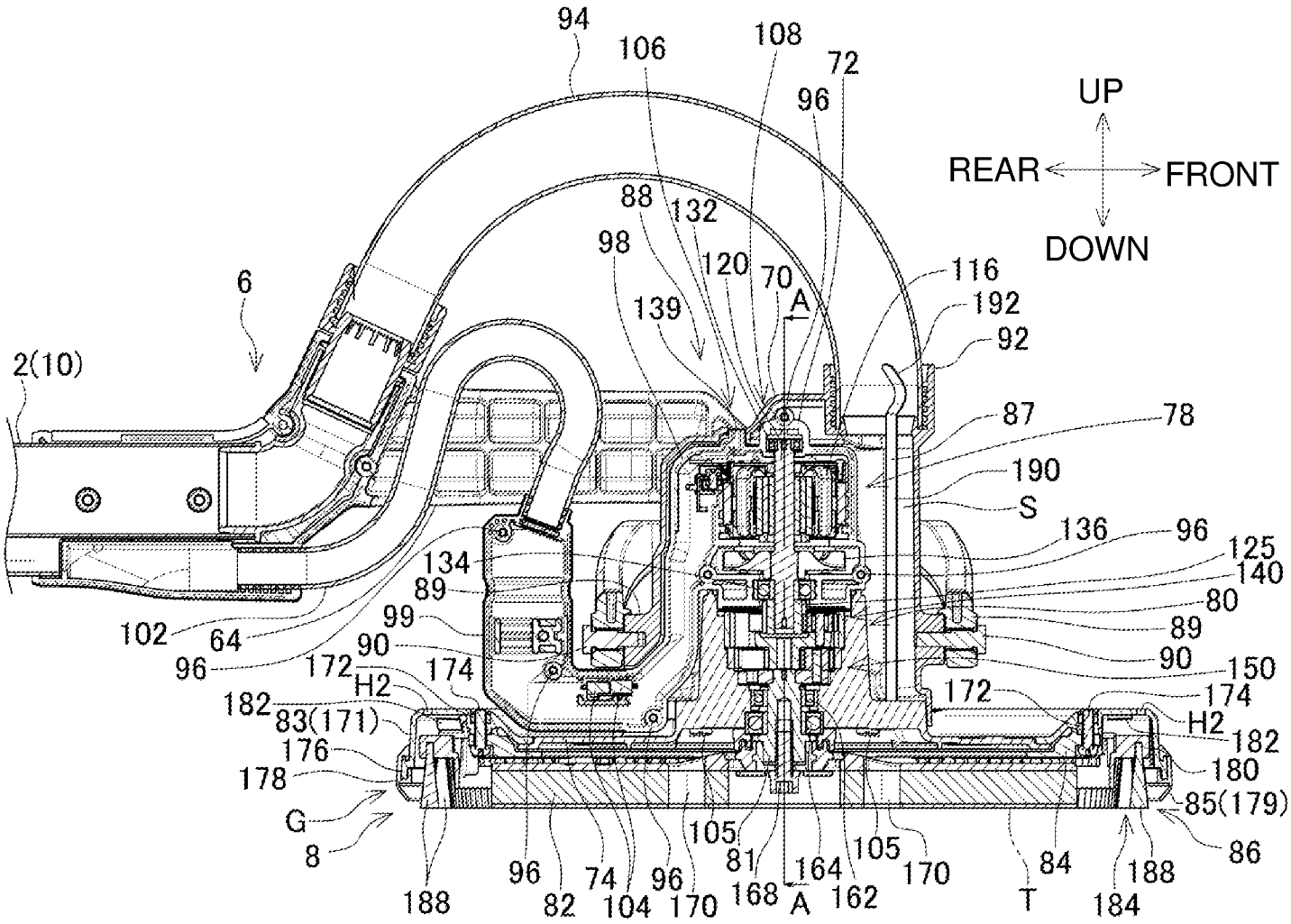
FIG. 4 is a longitudinal central sectional view of the front portion of the drywall sander in FIG. 1.
Figure 5:
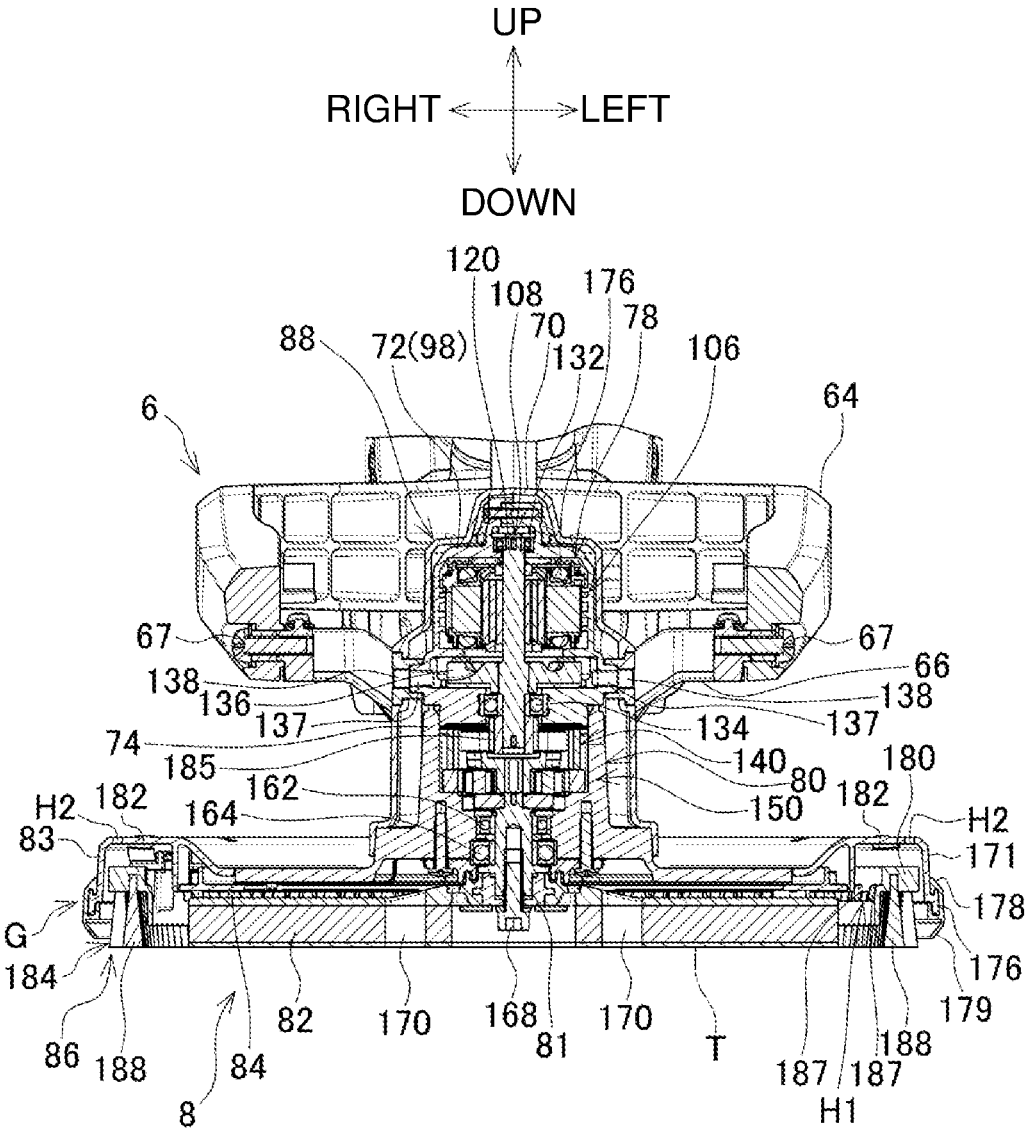
FIG. 5 is a cross-sectional view taken along line A-A in FIG. 4.

FIG. 3 is a right side view of a front portion of the drywall sander 1. FIG. 4 is a longitudinal central sectional view of the front portion of the drywall sander 1. FIG. 5 is a cross-sectional view taken along line A-A in FIG. 4.

The suspension frame unit 6 includes an outer frame 64 and an inner frame 66.

The outer frame 64 is laterally bifurcated and attached to a distal end of the larger-diameter pipe 10.

The inner frame 66 is connected to the inside of the distal ends of the outer frame 64 with left and right screws 67 in a manner rotatable about the axis in the lateral direction.

The inner frame 66 is rectangular as viewed from above and is V-shaped as viewed from the front and from the rear.

The head 8 is located between the lowermost portions of the front and the rear V-shaped portions of the inner frame 66. The head 8 is connected to the inner frame 66 in a manner rotatable about the axis in the front-rear direction.

The suspension frame unit 6 allows the head 8 to change its posture about the two axes in the lateral and front-rear directions. The relatively large outer frame 64 allows the head 8 to change its posture mainly about the axis in the lateral direction. The relatively small inner frame 66 allows the head 8 to change its posture supplementarily about the axis in the front-rear direction.

The head 8 is connected to the front end (first end) of the rod 2 with the suspension frame unit 6 in between.

The head 8 includes a head outer housing 70, a motor housing 72, a gear housing 74, an electric motor 78 as a driving source, a planetary gear assembly 80, a spindle 81, a pad 82, a head cover 83, a stopper 84, an air guide 85, a contact member 86, and a conductive plate 87.

The head outer housing 70, the motor housing 72, and the gear housing 74 form a head housing 88.

Figure 6:
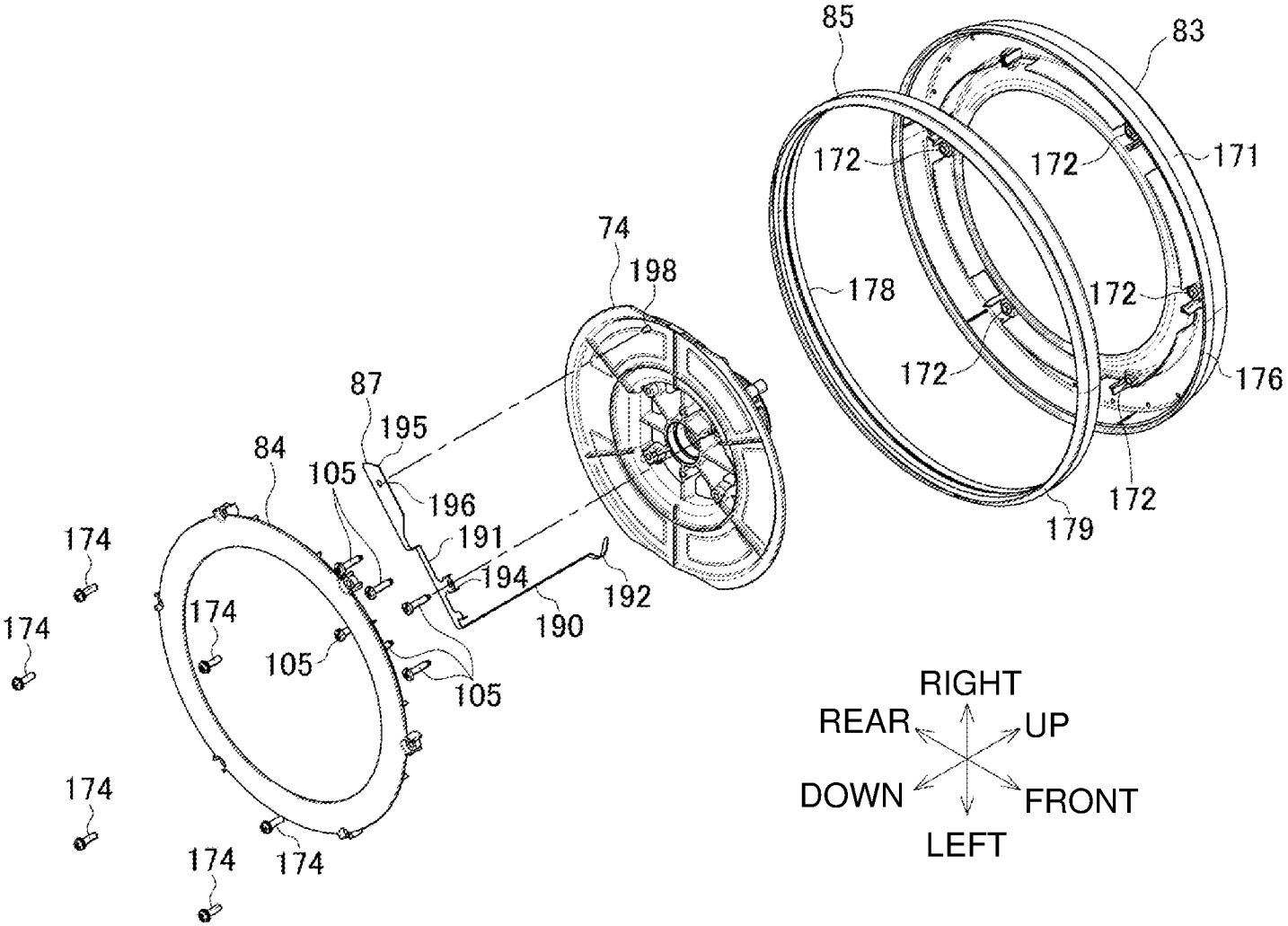
FIG. 6 is a partially exploded perspective view of the front portion of the drywall sander in FIG. 1.

FIG. 6 is an exploded perspective view of the gear housing 74, the head cover 83, the stopper 84, the air guide 85, and the conductive plate 87.

The head outer housing 70 is formed from plastic and is a bottomed cylinder that is open downward. Bosses 89 are located on the front and the rear of the head outer housing 70. The suspension frame unit 6 (inner frame 66) is connected to the bosses 89 with bolts 90 in the front-rear direction in a manner rotatable relative to each other.

A first hose connector 92 is located in a front upper portion of the head outer housing 70. The first hose connector 92 is a cylinder protruding upward from other portions. The first hose connector 92 receives the front end of a first hose 94. The first hose 94 communicating with the larger-diameter pipe 10 is connected to a rear upper portion of the suspension frame unit 6. The first hose 94 is routed to maintain a U shape as viewed laterally.

The first hose 94 is formed from conductive plastic. The first hose 94 contains a conductive material. The conductive material is, for example, carbon. To achieve sufficient electrical conductivity, the first hose 94 may contain 0.5% by weight of the conductive material or greater. To maintain electrical conductivity at a lower cost, the first hose 94 may contain 3% by weight of the conductive material or less. The first hose 94 containing the conductive material is electrically conductive, and thus reduces charging (or produces less static electricity).

The head outer housing 70 has an opening below the front boss 89.

The motor housing 72 is formed from plastic and located inside the head outer housing 70.

The motor housing 72 includes left and right halves joined with multiple (six) screws 96 laterally.

The motor housing 72 includes a cylindrical motor housing body 98 and an extension 99.

The extension 99 extends downward, rearward, and upward from a rear portion of the motor housing body 98.

The extension 99 has its rear exposed through an opening in the rear of the head outer housing 70.

The extension 99 receives, at its exposed upper end, the front end of a second hose 102. The second hose 102 communicating with the larger-diameter pipe 10 is connected to a rear lower portion of the suspension frame unit 6. The second hose 102 is routed to maintain a J shape as viewed laterally.

The rod lead wire extending from the controller in the handle 4 through the rod 2 has its front portion placed in the larger-diameter pipe 10, the second hose 102, and the extension 99. A pair of (male and female) connectors 104 are placed between portions of the rod lead wire placed in the extension 99. The pair of connectors 104 are detachable for their connection or disconnection.

The first hollow of the larger-diameter pipe 10 receives the rear end of the first hose 94. The second hollow of the larger-diameter pipe 10 receives the rear end of the second hose 102.

The gear housing 74 includes a cylindrical upper portion and a disk-shaped lower end. The gear housing 74 is attached below the motor housing 72 with multiple (six) screws 105 (FIG. 6) in the vertical direction.

The gear housing 74 has an opening in its upper end, which receives the lower end of the motor housing body 98. The rim of the upper surface of the lower portion of the gear housing 74 is received in the opening in the lower end of the head outer housing 70. The gear housing 74, together with the motor housing 72, is attached to the head outer housing 70. The gear housing 74 is formed from plastic.

The electric motor 78 is held on the motor housing 72.

The electric motor 78 is a direct current (DC)-driven brushless motor and held inside an upper portion of the motor housing body 98.

The electric motor 78 includes a stator 106 and a rotor 108. The electric motor 78 is an inner-rotor motor with the rotor 108 located inside the stator 106.

The stator 106 includes multiple (six) drive coils 116.

The rotor 108 includes a motor shaft 120 as a rotary drive shaft. The motor shaft 120 extends vertically and is coaxial with the rotation center axis of the rotor 108. A pinion 125 is integrally fixed on the lower end of the motor shaft 120. The pinion 125 includes multiple external teeth.

The stator 106 is electrically connected to the controller with the rod lead wire.

The controller controls the electric motor 78. The controller includes six switching elements (not shown). Each switching element corresponds to any one of the drive coils 116 and switches the drive coil 116. The controller includes a microcomputer (not shown). The microcontroller controls switching of the switching elements. The controller includes multiple elements for controlling the electric motor 78.

An upper bearing 132 is located above the stator 106. The upper bearing 132 supports the motor shaft 120 in a rotatable manner. The upper bearing 132 is held on the motor housing 72.

A lower bearing 134 is located above the pinion 125. The lower bearing 134 supports the motor shaft 120 in a rotatable manner. The lower bearing 134 is fixed to a lower central portion of the motor housing 72.

A cooling fan 136 is located between the lower bearing 134 on the motor shaft 120 and the stator 106. The fan 136 is fixed to the motor shaft 120. The fan 136 is a centrifugal fan. The fan 136 rotates to blow air in the centrifugal direction. The fan 136 is located in a middle portion of the motor housing 72. The motor housing 72 has internal outlets 137 in its left and right middle portions. The head outer housing 70 has external outlets 138 in its left and right middle portions and outward from the internal outlets 137.

The internal outlets 137 and the external outlets 138 are radially outside the fan 136. The air from the fan 136 is thus discharged efficiently.

The head outer housing 70 and the motor housing 72 have multiple inlets 139 in their upper portions. The inlets 139 connect the outside and the inside of the motor housing 72 for ventilation.

The planetary gear assembly 80 is held on an upper portion of the gear housing 74.

The planetary gear assembly 80 includes metal double-stage planetary gear trains. The planetary gear trains surround a vertical axis (including the center axes of the motor shaft 120 and the spindle 81) with the gear housing 74 being an outer wall. The planetary gear assembly 80 reduces the rotation of the motor shaft 120 and transmits the rotation to the spindle 81. More specifically, the planetary gear assembly 80 includes an upper planetary gear train 140 (reducer in a first stage) and a lower planetary gear train 150 (reducer in a second stage).

The spindle 81 is formed from metal and is located in a lower portion of the gear housing 74. The spindle 81 has the rear end attached to a center portion of a carrier in the lower planetary gear train 150.

The spindle 81 is rotatably supported by a spindle upper bearing 162 and a spindle lower bearing 164. The spindle upper bearing 162 and the spindle lower bearing 164 are held on the gear housing 74.

The pad 82 is formed from plastic and is disk-shaped. The pad 82 is attached to the spindle 81 with a screw 168 in the vertical direction. The pad 82 has its upper portion placed inside the contact member 86.

The pad 82 is located below the motor housing 72.

The lower surface of the pad 82 receives a tip tool T such as sandpaper. The tip tool T is a grinding surface for grinding a target surface K of a processing target (FIG. 3), and is a processing surface for processing the target surface K.

The pad 82 has multiple pad holes 170. The pad holes 170 extend vertically. The pad holes 170 are arranged along an imaginary circle concentric with the pad 82. The pad holes 170 are arranged at circumferentially equal intervals. The tip tool T has tip tool holes similar to the pad holes 170.

The gear housing 74 has a vertical gear housing hole (not shown) in its lower front portion. A space S defined between the front of the head outer housing 70 and the front of the motor housing 72 is located above the gear housing hole. The first hose connector 92 is located above the space S. The front of the head outer housing 70 expands like a cylinder (half cylinder). The space S has a cylindrical shape extending vertically. The lower end of the space S communicates with a space communication hole (not shown in the first embodiment) in a lower portion of the gear housing 74.

Figure 7:
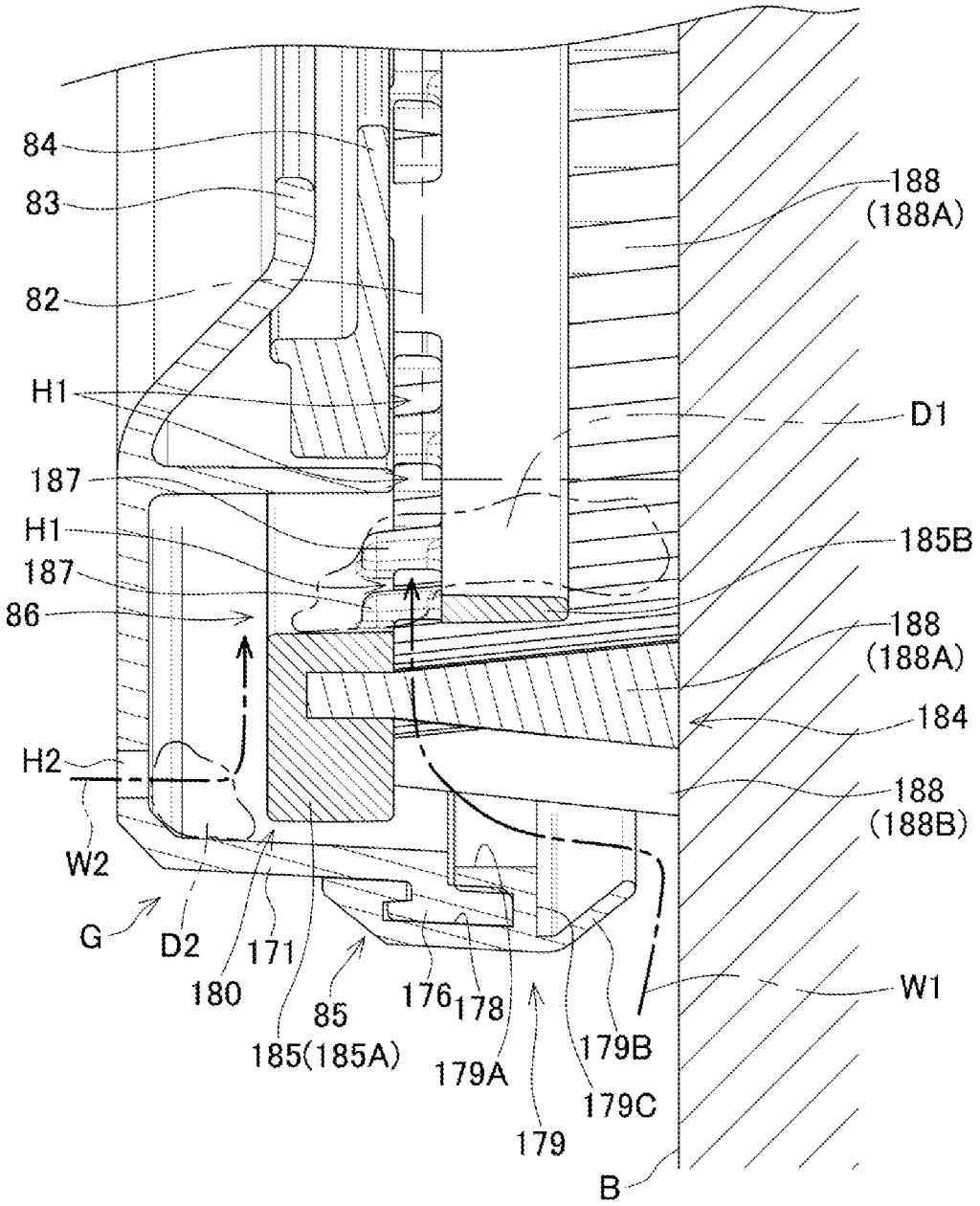
FIG. 7 is a partially enlarged cross-sectional view of a head cover, a stopper, an air guide, and a contact member included in the drywall sander in FIG. 1 during processing on a wall.

FIG. 7 is a partially enlarged cross-sectional view of the head cover 83, the stopper 84, the air guide 85, and the contact member 86 during processing on a wall B. The cross section corresponds to a vertical plane extending from the right front to the left rear. More specifically, the cross section corresponds to a plane extending in the front-rear and vertical directions, which is rotated counterclockwise by 45° as viewed from above about an imaginary vertical axis passing through the center of the head cover 83 and other components. The vertical, lateral, and front-rear directions with respect to the drywall sander 1 are the same as those described with reference to the drawings other than FIG. 7 irrespective of the directions indicated in FIG. 7 except for the vertical, lateral, and front-rear directions described for processing on the wall B described later as an operation example.

The head cover 83 is formed from plastic and is annular. The head cover 83 includes, on its periphery, a vertical wall base 171 shaped like a cylindrical wall. The vertical wall base 171 protrudes downward from other portions. The head cover 83 has multiple (six) screw bosses 172. The screw bosses 172 are arranged in the circumferential direction of the head cover 83.

The head cover 83 has multiple upper through-holes H2. The upper through-holes H2 are arranged along the periphery of the upper surface of the head cover 83. Each upper through-hole H2 has its center located on an imaginary concentric circle.

The stopper 84 is located below the head cover 83. The stopper 84 is formed from plastic and is annular. The stopper 84 is fastened to the head cover 83 with multiple (six) screws 174 in the vertical direction. Each screw 174 is received in its corresponding screw boss 172.

The air guide 85 is located on the vertical wall base 171 in the head cover 83. The air guide 85 is an elastic (rubber) ring member.

More specifically, the air guide 85 is formed from a non-staining material. In other words, the air guide 85 is formed from non-staining rubber. The non-staining rubber contains rubber as a base mixed with a non-staining coupling agent. This reduces the likelihood that the air guide 85 in contact with the target surface K or any other surface stains the target surface K or any other surface.

The air guide 85 has its upper portion engaged with the vertical wall base 171 in the head cover 83 to be fixed to the head cover 83 in a detachable manner. The vertical wall base 171 in the head cover 83 has a protrusion 176 on a lower outer edge. The protrusion 176 protrudes radially outward from other portions. The protrusion 176 is annular as a whole. The protrusion 176 is T-shaped in a vertical cross section. The air guide 85 has a groove 178 in its upper portion. The groove 178 has a recess having the shape corresponding to the protrusion 176. The protrusion 176 is fitted into the groove 178 to attach the air guide 85 to the head cover 83.

The middle portion and the lower portion of the air guide 85 define a vertical wall extension 179 shaped like a cylindrical wall and a conical wall. The vertical wall extension 179 is an extension of the vertical wall base 171 in the head cover 83. The vertical wall extension 179 and the vertical wall base 171 form a vertical wall G. The vertical wall extension 179 has its upper portion being a vertical wall extension upper portion 179A. The vertical wall extension upper portion 179A includes an inner surface of the cylindrical wall inside the lower portion of the groove 178. The vertical wall extension 179 has its lower portion being a vertical wall extension lower portion 179B. The vertical wall extension lower portion 179B includes an inner surface of the conical wall below the groove 178. The vertical wall extension lower portion 179B is tapered downward. More specifically, the vertical wall extension lower portion 179B has an inner diameter gradually decreasing downward. The vertical wall extension upper portion 179A and the vertical wall extension lower portion 179B are connected with an annular horizontal surface 179C in between.

The vertical wall extension lower portion 179B may be tapered upward or may extend vertically. The vertical wall base 171 may also be modified as well. The vertical wall base 171 and the vertical wall extension 179 may extend (may be tapered) in the same direction. The inner surface of the vertical wall extension upper portion 179A and the inner surface of the vertical wall extension lower portion 179B may be a continuous conical wall or a continuous cylindrical wall. The head cover 83 (vertical wall base 171) may be integral with the air guide 85 (vertical wall extension 179). The air guide 85 may include the vertical wall extension 179 alone.

The head cover 83 and the stopper 84 are attached to radially outer portions in the lower end (disk-shaped portion) of the gear housing 74. The disk-shaped portion in the gear housing 74 has its edge received between the radially inner edge of the head cover 83 and the radially inner edge of the stopper 84. Under no external force, a frictional force generated by the head cover 83 and the stopper 84 causes the head cover 83 and the stopper 84, and the air guide 85 and the contact member 86 to remain stationary with respect to the gear housing 74. Under an external force, the head cover 83 and the stopper 84, and the air guide 85 and the contact member 86 can rotate around the disk-shaped portion in the gear housing 74 about a vertical imaginary rotation axis bidirectionally by 360 degrees.

The head cover 83, the stopper 84, the air guide 85, and the contact member 86 rotate upon coming in contact with, for example, the wall B, a ceiling, or a floor. At least either the head cover 83 or the air guide 85 can come in contact with the wall B or any other surface. The contact reduces shock to the head 8, and allows smooth rotation of the contact member 86 and other members.

Figure 8:
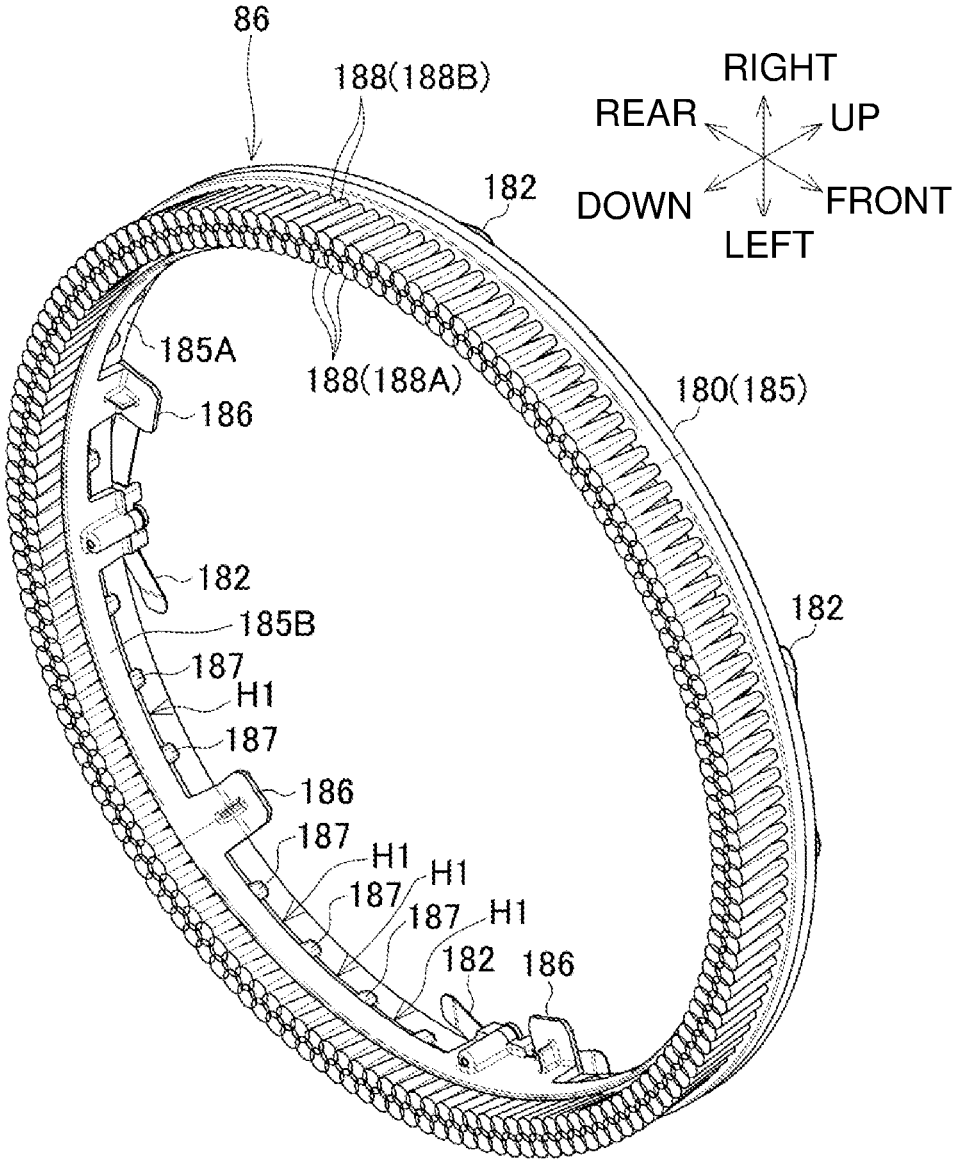
FIG. 8 is a perspective view of the contact member in the drywall sander in FIG. 1 as viewed from below.
Figure 9:
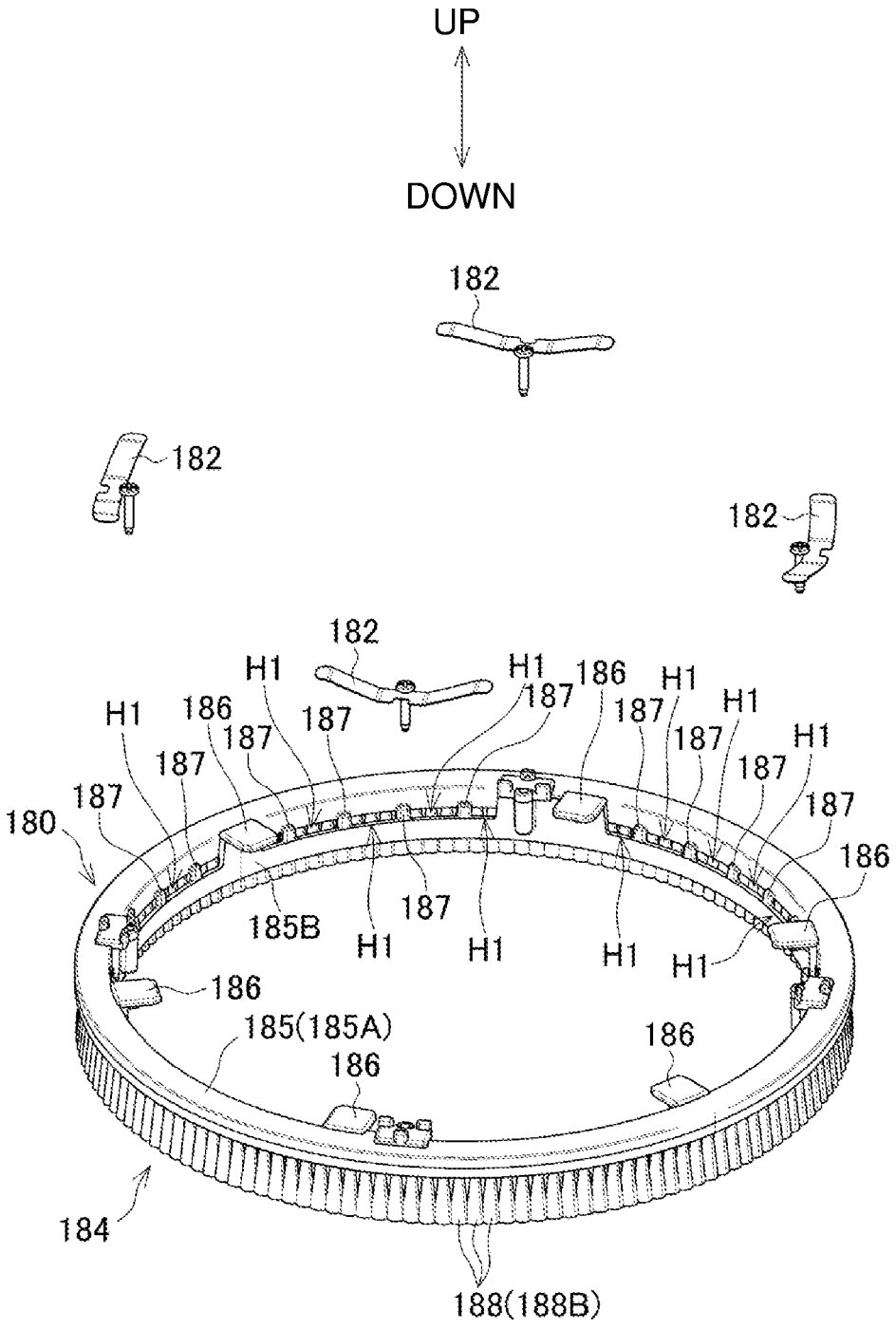
FIG. 9 is an exploded perspective view of the contact member in FIG. 8 as viewed from above.

FIG. 8 is a perspective view of the contact member 86 as viewed diagonally from below. FIG. 9 is a perspective view of the contact member 86 as viewed diagonally from above.

The contact member 86 is located below the head cover 83. The contact member 86 is cylindrical as a whole.

The contact member 86 includes a brush holder 180, multiple (four) leaf springs 182 as elastic members, and a brush 184.

The brush holder 180 is formed from conductive plastic. The brush holder 180 is located below the head cover 83 and radially inward from the vertical wall base 171 in the head cover 83. The brush holder 180 includes an annular holder body 185 and multiple (six) protruding tabs 186.

The holder body 185 includes a holder body base 185A being the upper part of its annular shape and a holder body wall 185B being the lower part of its annular shape. The holder body base 185A and the holder body wall 185B are concentric. The holder body base 185A has a larger diameter than the holder body wall 185B. The holder body wall 185B extends vertically and circumferentially. The holder body 185 includes multiple connection portions 187. The connection portions 187 connect the holder body base 185A and the holder body wall 185B together. The connection portions 187 are arranged at circumferentially equal intervals. A through-hole H1 is located between each pair of connection portions 187 circumferentially adjacent to each other. Each through-hole H1 extends circumferentially. A connection portion 187 is located between a pair of through-holes H1 adjacent to each other. The sum of the lengths of all through-holes H1 in the circumferential direction is greater than the sum of the lengths of all portions (all connection portions 187) each between adjacent ones of the through-holes H1 in the circumferential direction. The set of through-holes H1 are spaced from one another along the full circumference of the holder body 185.

The upper through-holes H2 are located above the holder body base 185A.

Each protruding tab 186 protrudes radially inward from an upper edge of the holder body wall 185B. Each protruding tab 186 can be in contact with the upper surface of the stopper 84. With the protruding tabs 186 being in contact with the upper surface of the stopper 84, the contact member 86 is supported not to slip off downward. The head cover 83 has its lower surface above the protruding tabs 186 with a clearance between them.

Each leaf spring 182 is a V-shaped metal piece. The leaf springs 182 are placed between the brush holder 180 and the head cover 83. Each leaf spring 182 has its center fixed to the upper end of the brush holder 180. Each leaf spring 182 has its two ends fixed to the head cover 83. The leaf springs 182 are located in front, rear, left, and right portions on the upper surface of the brush holder 180. Some or all of the leaf springs 182 may be fixed to either the head cover 83 or the brush holder 180.

The brush 184 includes multiple bristle bundles 188. The bristle bundles 188 are attached to the holder body base 185A. The bristle bundles 188 extend downward from the lower surface of the holder body base 185A. The bristle bundles 188 are embedded in the holder body base 185A. The holder body wall 185B and the through-holes H1 are located radially inward from the brush 184. The holder body wall 185B and the brush 184 are oriented in the same (vertical) direction. The bristle bundles 188 have their lower ends aligned in a single imaginary plane. Although each bristle bundle 188 is a bundle of bristles, the bundle is indicated by an imaginary outline in drawings for simplicity.

As shown in FIG. 7, the vertical length of the vertical wall extension 179 is greater than the vertical length between the lower end of the vertical wall extension 179 and the lower end of the brush 184. The lower end of the brush 184 herein corresponds to a position aligned with the lower surface of the pad 82 (tip tool T) in the vertical direction.

Substantially half the bristle bundles 188 (bristle bundles 188A) are arranged to be in contact with adjacent bristle bundles along a first imaginary circle used for arranging the bristle bundles. The remaining substantially half of the bristle bundles 188 (bristle bundles 188B) are arranged to be in contact with adjacent bristle bundles along a second imaginary circle used for arranging the bristle bundles. The second imaginary circle for the bundle arrangement has a larger diameter than the first imaginary circle for the bundle arrangement. The second imaginary circle for the bundle arrangement is concentric with the first imaginary circle for the bundle arrangement. Each bristle bundle 188B has its vertical central axis located between the vertical central axes of bristle bundles 188A adjacent to each other. Two bristle bundles 188B adjacent to a bristle bundle 188A are in contact with the bristle bundle 188A. In other words, the bristle bundles 188 are arranged to be in contact with adjacent bristle bundles 188 in a staggered manner along a middle imaginary circle between the first imaginary circle for the bundle arrangement and the second imaginary circle for the bundle arrangement.

Each bristle in a bristle bundle 188 is formed from a first plastic (e.g., a polyamide) or a second plastic (e.g., conductive polypropylene). In other words, each bristle bundle 188 includes bristles formed from the first plastic and bristles formed from the second plastic. The ratio of the bristles formed from the first plastic to the bristles formed from the second plastic is about 9:1. The bristles are arranged evenly to maintain this ratio at any position. The conductive second plastic reduces the likelihood of the bristle bundle 188 being charged with static electricity. The bristle bundle 188 includes a sufficient amount of bristles formed from the second plastic to reduce electrification. The remaining bristles are formed from the first plastic. This can lower the cost and achieve sufficient strength of the brush as compared with all the bristles formed from the second plastic.

In some embodiments, bristle bundles 188 including bristles formed from the first plastic alone and bristle bundles 188 including bristles formed from the second plastic alone may be arranged in a mixed manner. In some embodiments, each bristle bundle 188 may include bristles formed from the first plastic alone or bristles formed from the second plastic alone. The electrical conductivity of the plastic may be achieved in the same manner as for the first hose 94 described above.

The contact member 86 surrounds the radially outer surface of the pad 82. The contact member 86 surrounds the lower surface (tip tool T) of the pad 82. With the leaf springs 182 having an equilibrium length or a length closer to the equilibrium length, the lower ends of the bristle bundles 188 are located downward from the tip tool T in the vertical direction. The contact member 86 can, with the lower ends of the bristle bundles 188, be in contact with the wall B or any other surface.

The leaf springs 182 urge, via the brush holder 180, the brush 184 downward, or more specifically toward the target surface K.

The conductive plate 87 is formed from metal. The conductive plate 87 is L-shaped as a whole. The conductive plate 87 includes an arm 190 extending vertically and a base 191 extending substantially horizontally.

The arm 190 has its middle portion located in the space S defined between the front of the head outer housing 70 and the front of the motor housing 72. The arm 190 has an arched contact 192 at its upper end. The contact 192 protrudes toward the left front with respect to other portions. The contact 192 is in contact with the inner surface of the first hose 94.

The base 191 has a screw hole 194 at its center. The screw hole 194 receives a screw 105. The screw 105 fastens the gear housing 74 to the motor housing 72. The base 191 has an insertion portion 195 at its distal end. The insertion portion 195 is stepped to be slightly lower than other portions. The insertion portion 195 is wider than other portions. The insertion portion 195 has a hole 196. The gear housing 74 has a projection 198 on the lower surface of its disk-shaped portion. The projection 198 protrudes downward with respect to the surrounding portion. The projection 198 is received in the hole 196 in the insertion portion 195. The insertion portion 195 has its distal end placed between the gear housing 74 and the stopper 84.

When a user places the head 8 on the target surface K, the brush 184 in the contact member 86 first comes in contact with the target surface K. The user further presses the head 8 against the target surface K, causing the tip tool T on the pad 82 to come in contact with the target surface K. In other words, the brush 184 in the contact member 86 facing the target surface K can come in contact with the target surface K together with the tip tool T on the lower surface of the pad 82. The brush 184 comes in contact with the target surface K before the tip tool T comes in contact with the target surface K.

The contact member 86 then receives, at the lower end of the brush 184, a reaction force from the target surface K. The brush holder 180 moves upward against the urging force from the leaf springs 182 with respect to the head cover 83 and the stopper 84. The upper end of the brush holder 180 is received in a space below the peripheral edge of the head cover 83. The protruding tabs 186 in the brush holder 180 are closer to the lower surface of the head cover 83.

The suspension frame unit 6, which allows the head 8 to rotate about the two axes, causes the head 8 to move freely, thus causing the brush 184 to first come in contact with the target surface K. This causes a pressing force to the tip tool T to be applied in the direction perpendicular to the tip tool T (the axial direction of the contact member 86, or the vertical direction in the drawing) alone. Any pressing force to the tip tool T applied in other directions becomes a rotational force for the head 8 to rotate relative to the suspension frame unit 6. Thus, the entire tip tool T comes in contact with the target surface K. This reduces the likelihood that the rotating tip tool T partially comes in contact with a target.

When the user moves the head 8 relative to the target surface K in various directions, the contact member 86 allows the entire tip tool T to come in contact with the target surface K. When the user changes the posture of the rod 2 at various angles relative to the target surface K, the contact member 86 allows the entire tip tool T to come in contact with the target surface K.

In response to the head 8 being removed from the target surface K, the brush holder 180 and the brush 184 return downward (toward the target surface K) under the urging force from the leaf springs 182. This causes the brush 184 to have its lower end protruding downward in the vertical direction with respect to the tip tool T.

The drywall sander 1 according to the present embodiment may operate in the manner described below.

A user mounts the charged battery 50 on the battery mount 26.

The user loosens the outer cylinder 34 to extend or retract the rod 2 and tightens the outer cylinder 34 with the rod 2 with an intended length. The length of the rod 2 is thus adjusted.

The user then pulls the trigger 40 with the trigger locking member 44 being disengaged. This turns on the switch, causing the controller to feed power from the battery 50 to the electric motor 78 through the rod lead wire (power lead wire) and rotating the motor shaft 120. The trigger 40 switches the on-off state of the electric motor 78 through the switch. The trigger 40 is thus a switching member for turning on or off the electric motor 78. The trigger 40 and the switch form a main switch for the electric motor 78.

The switching elements in the controller switch the drive coils 116 in accordance with the rotational position of the rotor 108. This rotates the rotor 108 (motor shaft 120).

The rotational force of the motor shaft 120 is reduced by the planetary gear assembly 80 before being transmitted to the spindle 81 and rotates the pad 82 attached to the distal end of the spindle 81.

The rotating pad 82 is pressed against a processing target and moved on the processing target with the grip 24 and the rod 2 gripped for processing such as grinding the target surface K.

The processing target is, for example, the wall B of a building or a drywall (plaster board) covering a ceiling. More specifically, the processing target is putty for filling screw holes and joints during application of drywall. A putty portion protruding from other part of the drywall is leveled by grinding.

During processing, the suspension frame unit 6 allows the orientation of the head 8, or more specifically the orientation of the pad 82 with respect to the rod 2, to be adjusted within a predetermined range. The contact member 86 first comes in contact with the target surface K. The tip tool T then comes in contact with the target surface K. This reduces the likelihood that the tip tool T is not parallel to the target surface K and thus comes in contact with the target surface K unevenly.

As the motor shaft 120 rotates, the fan 136 rotates, discharging air through the internal outlets 137 and the external outlets 138. This produces a flow of air (wind) from the inlets 139 toward the external outlets 138. The wind blows downward in the motor housing body 98 to reach the fan 136 in the middle portion.

The wind cools the internal components of the head 8 including the electric motor 78.

In particular, the wind internally blowing downward from an upper portion of the motor housing body 98 passes between the stator 106 and the rotor 108 in the electric motor 78. The electric motor 78 is thus cooled efficiently.

The controller is cooled by air drawn in through the air vents 58 by natural convection.

In response to the switch being turned on, the wireless communication controller in the controller controls the wireless communication adapter 62 to perform wireless communication with the dust collector wireless communication adapter to activate the dust collector.

The dust collector collects dust by sucking air in the manner described below. Dust produced around the pad 82 and the tip tool T rotating as appropriate during processing is sucked by the dust collecting hose through three routes described below.

A first route extends from the tip tool holes and the pad holes 170, to the gear housing hole, between the head outer housing 70 and the gear housing 74, and through the space S between the head outer housing 70 and the motor housing 72 to the first hose 94. The first route further extends from the first hose 94 to the joint 30 through the larger-diameter pipe 10 and the smaller-diameter pipe 12. Dust that has travelled the first route is sucked into the dust collecting hose.

A second route extends from between the vertical wall extension 179 and the brush 184 through the brush 184 (between multiple bristle bundles 188), and between the pad 82 and the head cover 83, and through the cylindrical portion of the gear housing 74 to the gear housing hole. The second route then joins the first route.

A third route extends from the upper through-holes H2 to between the head cover 83 and the brush holder 180, and then joins the second route.

A dust collection path including the first to third routes is thus defined.

An example operation of the pad 82 processing the vertical wall B will now be described below. For the explanation of this example alone, the vertical, front-rear, and lateral directions as shown in FIG. 7 are used. FIG. 7 does not show the pad 82.

When a user processes the vertical wall B, the tip tool T attached to the pad 82 extends vertically and laterally along the vertical plane of the wall B. In this case, dust D1 and dust D2 may accumulate as shown in FIG. 7. The dust D1 accumulates inside the contact member 86. The dust D2 accumulates inside the vertical wall base 171 in the head cover 83.

The dust D1 that may accumulate is blown out by a wind W1 occurring in the second route in the dust collection path described above. The wind W1 first passes through a gap between the wall B and the vertical wall extension lower portion 179B. The gap is narrower with the vertical wall extension 179 than without the vertical wall extension 179. The wind W1 thus passes through the gap faster. The wind W1 is then directed horizontally while passing between the vertical wall extension 179 and the brush 184. The wind W1 is then redirected vertically by the holder body base 185A and passes through the brush 184 (between multiple bristle bundles 188). The wind W1 then passes through through-holes H1 at a lower position and between the pad 82 and the head cover 83, and through the cylindrical portion of the gear housing 74 to the gear housing hole. The wind W1 is then sucked. Before entering the through-holes H1, the wind W1 is regulated by the bristle bundles 188 that serve as slits.

The dust D2 that may accumulate is blown out by a wind W2 occurring in the third route in the dust collection path described above. In other words, the wind W2 from the upper through-holes H2 restricts accumulation of the dust D2.

A portion of the wind W1 reaching around the holder body base 185A passes between the holder body base 185A and the vertical wall base 171 to merge with the wind W2. The portion of the wind W1 blows out the dust D2. Without the upper through-holes H2, the wind W1 branched to correspond to the wind W2 blows out the dust D1 and the dust D2.

When the drywall sander 1 performs processing, the target surface K and dust are charged positively and negatively, producing static electricity in the portions of the path through which the charged dust passes. The static electricity is discharged into the target surface K through the larger-diameter pipe 10, the first hose 94, the conductive plate 87, the stopper 84, the brush holder 180, and the brush 184 to neutralize electric charge produced during processing. More specifically, static electricity produced in the internal dust collection path is transferred from the first hose 94 to the arm 190 in the conductive plate 87, a portion of the base 191, the insertion portion 195, and then the stopper 84, the brush holder 180, and to the brush 184. With the electric charge of dust discharged onto the target surface K, static electricity in the target surface K is neutralized. This restricts scattering of uncollected dust from adhering to the target surface K, as well as reducing the accumulation of static electricity in the drywall sander 1.

The contact 192 in the arm 190 is an elastic leaf spring. The contact 192 is thus reliably in contact with the first hose 94.

The conductive plate 87 is efficiently and reliably fastened to the gear housing 74 with a screw 105 that fastens the gear housing 74 to the motor housing 72. The insertion portion 195 is reliably fastened to the gear housing 74 with the hole 196 receiving the projection 198. The head cover 83 and other components thus rotate smoothly with the insertion portion 195 placed in between.

The drywall sander 1 described above includes the head 8 and the rod 2. The head 8 includes the electric motor 78 and the pad 82 movable with a driving force from the electric motor 78. The rod 2 has an end connected to the head 8. The rod 2 extends in the front-rear direction. The head 8 includes the vertical wall G surrounding the radially outer edge of the pad 82, and the contact member 86 located between the vertical wall G and the pad 82 and surrounding the radially outer edge of the pad 82. The contact member 86 includes the brush holder 180 and the brush 184 below the brush holder 180. The brush 184 has its lower end located downward from the lower end of the vertical wall G. The brush holder 180 has the through-holes H1 extending in the radial direction of the pad 82.

The long rod grinding machine thus reduces the likelihood of the dust D1 escaping and falling.

The through-holes H1 are located upward from the lower end of the vertical wall G. This shortens the time for which the wind W2 is in contact with the rotating pad 82, reducing the likelihood that the rotating pad 82 reduces the speed of the wind W2 and reliably reducing the likelihood of dust escaping and falling.

The brush holder 180 includes the holder body base 185A and the holder body wall 185B. The brush 184 and the holder body wall 185B are oriented in the same direction. The through-holes H1 are located between the holder body base 185A and the holder body wall 185B and radially inward from the brush 184. The wind W1 is thus regulated while passing through bristles in the bristle bundles 188 in the brush 184. This reduces accumulation of the dust D1 more efficiently.

The multiple through-holes H1 are arranged in the circumferential direction. The sum of the lengths of all through-holes H1 in the circumferential direction is greater than the sum of the lengths of all portions (all connection portions 187) each between adjacent ones of the through-holes H1 in the circumferential direction. The wind W1 thus has an airflow rate to blow out the dust D1.

The head 8 includes the head cover 83 and the air guide 85 attached to a lower portion of the head cover 83. The vertical wall G includes the vertical wall base 171 being a part of the head cover 83 and the vertical wall extension 179 being a part of the air guide 85 or being the entire air guide 85. The vertical wall extension 179 has a vertical length greater than the vertical length between the lower end of the vertical wall extension 179 and the lower end of the brush 184. This structure allows the gap between the target surface K such as the wall B and the lower end of the vertical wall extension 179 to be narrower. The wind W1 thus blows faster, more efficiently reducing the likelihood of the dust D1 escaping and falling. The target surface K may be processed without the air guide 85 being attached depending on, for example, the state of the target surface K.

The air guide 85 is an elastic member. Thus, the air guide 85 coming in contact with the target surface K is less likely to cause damage such as scratches to the target surface K. The drywall sander 1 is also protected from shock from the air guide 85 coming in contact with the target surface K.

The air guide 85 is formed from a non-staining material. Thus, the air guide 85 coming in contact with the target surface K is less likely to stain the target surface K.

The head 8 includes the head cover 83 located over the contact member 86. The head cover 83 has the upper through-holes H2 above the contact member 86. This structure reduces accumulation of the dust D2 inside the head cover 83 more efficiently.

The multiple through-holes H1 are arranged in the circumferential direction. The set of through-holes H1 are spaced from one another along the full circumference of the brush holder 180. Thus, with the head cover 83 at any rotational position, or with the rod 2 at any position relative to the head 8, any through-holes H1 located downward during processing on the wall B reliably blow out the dust D1 accumulating in a lower portion.

The head 8 includes the head housing 88. The contact member 86 is rotatable about a vertical imaginary rotation axis relative to the head housing 88 (gear housing 74) with the head cover 83 between them. Thus, the head cover 83 and the contact member 86 coming in contact with a ceiling during processing on the wall B rotate relative to the gear housing 74. In this state, the head cover 83 and the contact member 86 roll on the ceiling surface, allowing smooth movement of the head 8. The head 8 and the drywall sander 1 are protected from shock from, for example, the ceiling.

The first embodiment of the present disclosure is not limited to the embodiment and modifications described above. For example, the above embodiment and modifications of the present disclosure may be further modified appropriately as described below.

The vertical wall G may be formed as a single member or may include three or more members.

The bristle bundles 188 in the brush 184 may be arranged along a single imaginary circle or three or more imaginary circles for the bundle arrangement and may be arranged in a manner other than a staged manner.

The contact member 86 may include multiple sections separate from one another in the circumferential direction. For example, the contact member 86 may include a contact member base that forms about three quarters of the full circumference, and a detachable contact member attachment that forms about the remaining one quarter.

The planetary gear assembly 80 may have a single stage or three or more stages. A reducer of a different type may be used.

For example, the number, the arrangement, and the size of at least any of the air vents 58, the internal outlets 137, the external outlets 138, and the inlets 139 may be modified variously.

The fan 136 may be any fan other than a centrifugal fan.

The electric motor 78 may be an outer-rotor motor or a brushed motor. The electric motor 78 may be connectable to utility power with a power cable, or drivable with alternating current (AC).

The pad 82 may move eccentrically with an eccentric spindle. The pad 82 may have any shape such as a triangle. The pad 82 may integrate a grinding surface (processing portion). In this case, the pad 82 serves as the tip tool T.

At least any of the functions, arrangements, types, models, and the number of any components or portions may be modified as appropriate. For example, more or fewer bearings, screws, and buttons may be used. The buttons may be replaced by lever switches. The pinion 125 may be replaced by a belt and a pulley. The screws may be replaced by rivets. The motor housing 72 may be integral with the gear housing 74. The front handle housing 14 may be integral with the rear handle housing 15. The battery 50 may be rechargeable while being on the battery mount 26. A non-rechargeable battery may be used.

The present disclosure is applicable to a long rod polisher, a long rod grinder, a long rod grinding machine such as a long rod concrete plane, and any other long rod grinding machine (elongated rod grinding machine) to which a dust collector is connectable.

Second Embodiment

Figure 10:
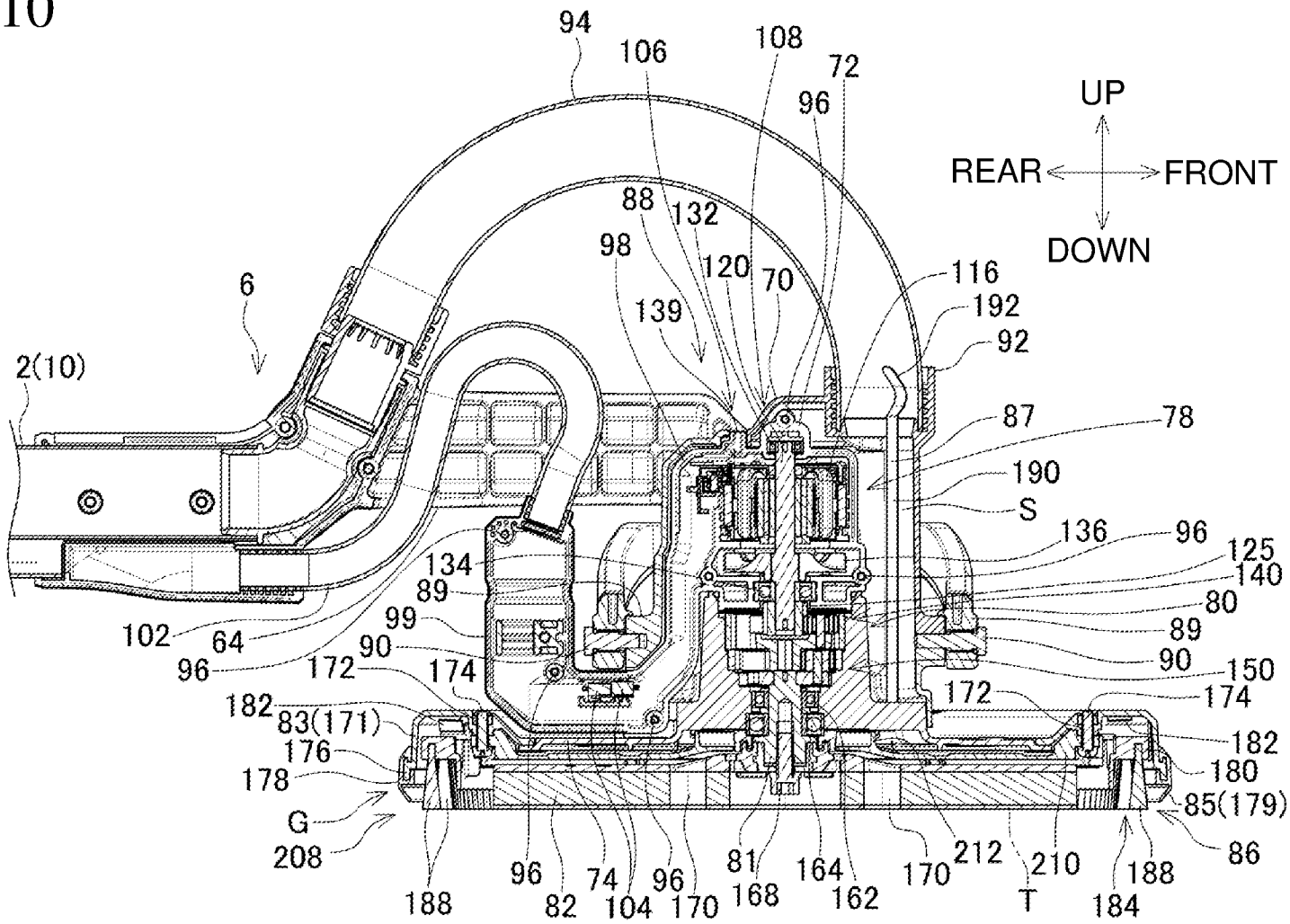
FIG. 10 is a longitudinal central sectional view of a front portion of a drywall sander according to a second embodiment.
Figure 11:
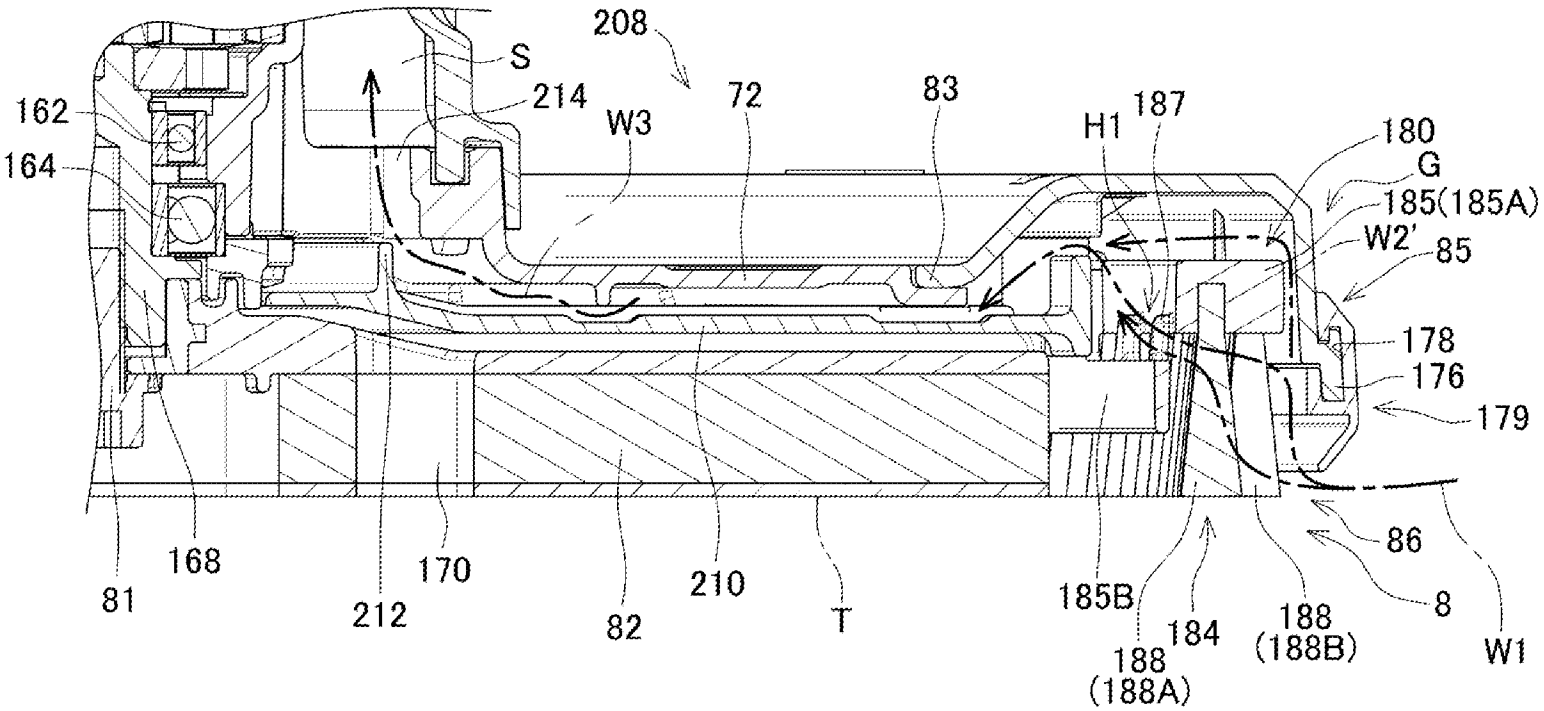
FIG. 11 is an enlarged cross-sectional view of a head cover, a stopper, an air guide, a contact member, and an airflow regulating plate included in the drywall sander according to the second embodiment.
Figure 12A:
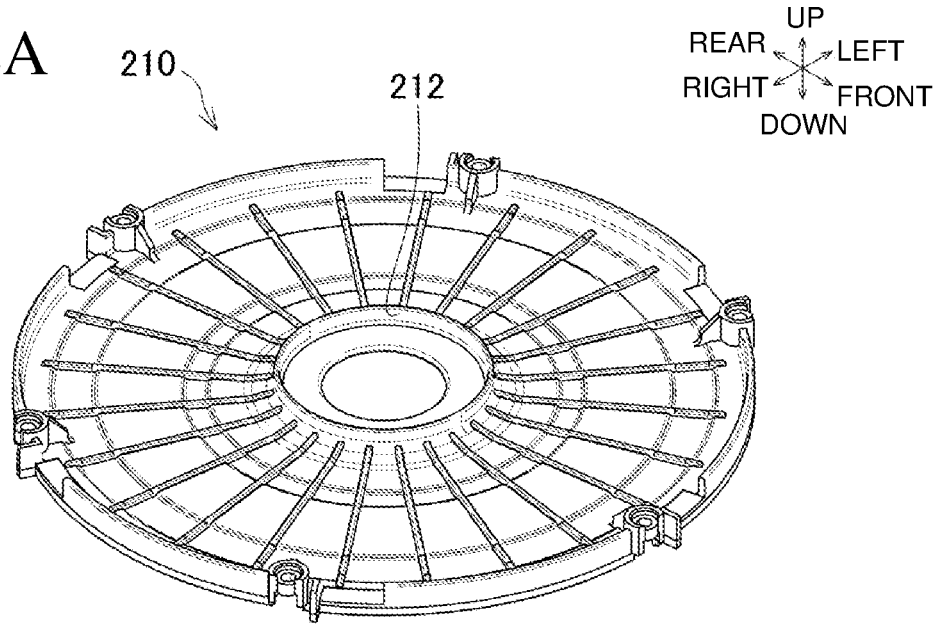
FIG. 12A is a perspective view of the airflow regulating plate in FIG. 11 as viewed from above.
Figure 12B:
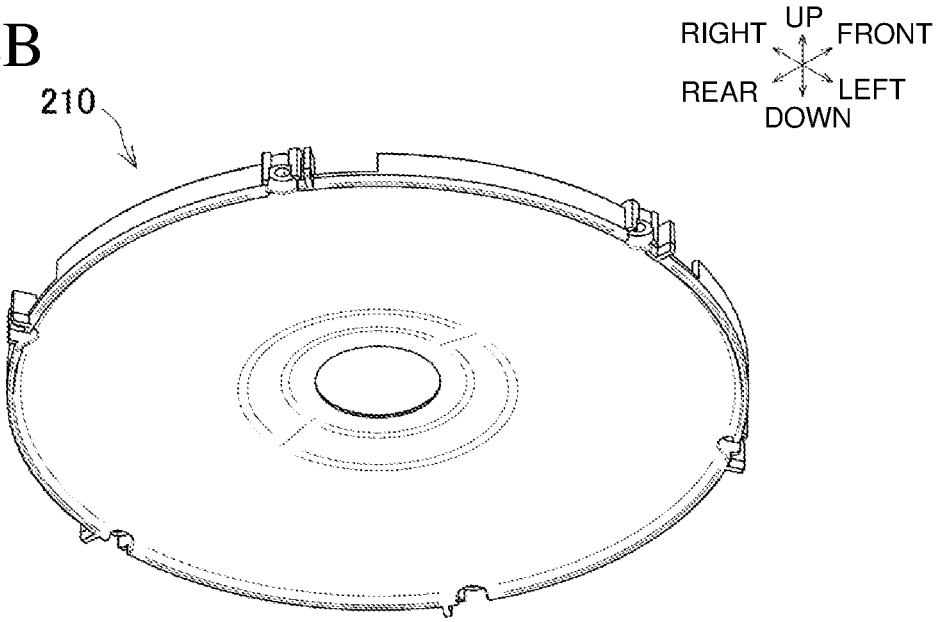
FIG. 12B is a perspective view of the airflow regulating plate in FIG. 11 as viewed from below.

FIG. 10 is a longitudinal central sectional view of a front portion of a drywall sander according to a second embodiment. FIG. 11 is an enlarged cross-sectional view of a head cover 83, an air guide 85, a contact member 86, and an airflow regulating plate 210 included in the drywall sander according to the second embodiment. The cross section in FIG. 11 corresponds to that in FIG. 7 in the first embodiment. FIG. 12A is a perspective view of the airflow regulating plate 210 in FIG. 11 as viewed from above. FIG. 12B is a perspective view of the airflow regulating plate 210 in FIG. 11 as viewed from below.

The drywall sander according to the second embodiment is the same as the drywall sander according to the first embodiment except for the difference between the stopper 84 in the head 8 and the airflow regulating plate 210 in a head 208 and for the absence of the upper through-holes H2.

In the second embodiment, similar components and portions as in the first embodiment are indicated by like reference numerals and will not be described.

The head 208 in the second embodiment does not have the upper through-holes H2 unlike the head cover 83.

The disk-shaped airflow regulating plate 210 having a center hole is located between the pad 82 and a lower portion of the gear housing 74 in the head 208. The airflow regulating plate 210 extends in the front-rear and lateral directions similarly to the pad 82. A center wall 212 stands around the center hole in the airflow regulating plate 210. The center wall 212 is cylindrical and protrudes upward from other portions.

The airflow regulating plate 210 is fixed to an inner lower portion of the disk-shaped portion of the gear housing 74 in a nonrotatable manner. The airflow regulating plate 210 replaces the stopper 84 in the first embodiment. The head cover 83 is rotatable about a vertical imaginary rotation axis relative to the lower portion of the gear housing 74 and the airflow regulating plate 210.

The spindle 81 and the screw 168 are placed inside the center hole in the airflow regulating plate 210. The center wall 212 has its front extending in the direction parallel to the space S between the head outer housing 70 and the motor housing 72 and a space communication hole 214 below the gear housing 74.

The airflow regulating plate 210 is not in contact with the pad 82 and thus does not prevent the pad 82 from moving.

The airflow regulating plate 210 has its rim located below the head cover 83. A space between the upper surface of the airflow regulating plate 210 and the lower surface of the head cover 83 and the lower surface of the gear housing 74 corresponds to the second route in the dust collection path in the first embodiment. The rim of the airflow regulating plate 210 may not extend to below the head cover 83.

The drywall sander according to the second embodiment may operate in the manner described below.

Also in the drywall sander according to the second embodiment, the wind W1 in the second route in the above dust collection path is generated, and the wind W1 is branched to generate a wind W2' in the third route radially outside the holder body base 185A. The winds W1 and W2' merge radially inside the holder body base 185A and enter a space between the head cover 83 and the airflow regulating plate 210. A wind W3 into which the winds W1 and W2' merge passes between the lower portion of the gear housing 74 and the airflow regulating plate 210 to reach the space communication hole 214.

The wind W1 mainly reduces accumulation of the dust D1. The wind W2' mainly reduces accumulation of the dust D2.

The wind W3 passes between the nonrotatable lower portion of the gear housing 74 and the nonrotatable airflow regulating plate 210. The wind W3 is thus less likely to be affected by rotation of the pad 82 and is thus more stable.

The head 208 in the drywall sander according to the second embodiment includes the head housing 88 (gear housing 74) located above the pad 82. The airflow regulating plate 210 is located between the pad 82 and the head housing 88 and extends similarly to the pad 82.

The winds W1 and W2' that reduce accumulation of the dust D1 and the dust D2 are thus more stable.

The second embodiment may be modified as appropriate in the same manner as the first embodiment.

The airflow regulating plate 210 may include multiple separate portions combined together. The airflow regulating plate 210 may rotate together with the head cover 83.

The upper through-holes H2 may be provided in the second embodiment.

REFERENCE SIGNS LIST

1 drywall sander (long rod grinding machine)
2 rod
8, 208 head
78 electric motor
82 pad
83 head cover
85 air guide
86 contact member
88 head housing
171 vertical wall base
179 vertical wall extension
180 brush holder
184 brush
185A holder body base
185B holder body wall
187 connection portion
188 bristle bundle
210 airflow regulating plate
D1, D2 dust
G vertical wall
H1 through-hole
H2 upper through-hole
K target surface
W1, W2 wind

What is claimed is:

1. A long rod grinding machine, comprising:
a head including:
an electric motor,
a pad movable with a driving force from the electric motor,
a vertical wall surrounding a radially outer edge of the pad, and
a contact member between the vertical wall and the pad, the contact member surrounding the radially outer edge of the pad, the contact member including
a brush holder having one or more through-holes extending in a radial direction of the pad, and
a brush below the brush holder, the brush having a lower end located downward from a lower end of the vertical wall; and
a rod having an end connected to the head, the rod extending in a front-rear direction,
wherein the brush holder includes:
a holder body base extending in a horizontal direction, and
a holder body wall extending vertically downward from a lower face of the holder body base at a radially inner side of the holder body base, and
wherein the brush includes multiple bristle bundles attached to the brush holder, and the multiple bristle bundles cover the one or more through-holes.

2. The long rod grinding machine according to claim 1, wherein
the one or more through-holes are located upward from the lower end of the vertical wall.

3. The long rod grinding machine according to claim 1, wherein
the brush and the holder body wall are oriented in a same direction, and
the one or more through-holes are between the holder body base and the holder body wall and radially inward from the brush.

4. The long rod grinding machine according to claim 1, wherein
the one or more through-holes include a plurality of through-holes arranged in a circumferential direction, and
a sum of lengths of the plurality of through-holes in the circumferential direction is greater than a sum of lengths of portions each between adjacent through-holes of the plurality of through-holes in the circumferential direction.

5. The long rod grinding machine according to claim 1, wherein
the head includes
a head cover, and
an air guide attached to a lower portion of the head cover,
the vertical wall includes
a vertical wall base being a part of the head cover, and
a vertical wall extension being a part of the air guide or being the air guide, and
the vertical wall extension has a vertical length greater than a vertical length between a lower end of the vertical wall extension and the lower end of the brush.

6. The long rod grinding machine according to claim 5, wherein
the air guide includes an elastic member.

7. The long rod grinding machine according to claim 5, wherein
the air guide comprises a non-staining material.

8. The long rod grinding machine according to claim 1, wherein
the head includes a head cover located over the contact member, and
the head cover has an upper through-hole above the contact member.

9. The long rod grinding machine according to claim 1, wherein
the one or more through-holes include a plurality of through-holes arranged in a circumferential direction, and
the plurality of through-holes are spaced from one another along a full circumference of the brush holder.

10. The long rod grinding machine according to claim 1, wherein
the head includes a head housing, and
the contact member is rotatable about a vertical imaginary rotation axis relative to the head housing.

11. A long rod grinding machine, comprising:
a head including
an electric motor,
a pad movable with a driving force from the electric motor,
a vertical wall surrounding a radially outer edge of the pad, and
a contact member between the vertical wall and the pad, the contact member surrounding the radially outer edge of the pad, the contact member including
a brush holder having one or more through-holes extending in a radial direction of the pad, and
a brush below the brush holder, the brush having a lower end located downward from a lower end of the vertical wall; and
a rod having an end connected to the head, the rod extending in a front-rear direction; wherein
the head includes a head housing above the pad, and
the long rod grinding machine further comprises an airflow regulating plate located between the pad and the head housing and extending similarly to the pad.

12. The long rod grinding machine according to claim 2, wherein
the brush and the holder body wall are oriented in a same direction, and
the one or more through-holes are between the holder body base and the holder body wall and radially inward from the brush.

13. The long rod grinding machine according to claim 2, wherein
the one or more through-holes include a plurality of through-holes arranged in a circumferential direction, and
a sum of lengths of the plurality of through-holes in the circumferential direction is greater than a sum of lengths of portions each between adjacent through-holes of the plurality of through-holes in the circumferential direction.

14. The long rod grinding machine according to claim 3, wherein
the one or more through-holes include a plurality of through-holes arranged in a circumferential direction, and
a sum of lengths of the plurality of through-holes in the circumferential direction is greater than a sum of lengths of portions each between adjacent through-holes of the plurality of through-holes in the circumferential direction.

15. The long rod grinding machine according to claim 2, wherein
the head includes
a head cover, and
an air guide attached to a lower portion of the head cover,
the vertical wall includes
a vertical wall base being a part of the head cover, and
a vertical wall extension being a part of the air guide or being the air guide, and
the vertical wall extension has a vertical length greater than a vertical length between a lower end of the vertical wall extension and the lower end of the brush.

16. The long rod grinding machine according to claim 3, wherein
the head includes
a head cover, and
an air guide attached to a lower portion of the head cover,
the vertical wall includes
a vertical wall base being a part of the head cover, and
a vertical wall extension being a part of the air guide or being the air guide, and
the vertical wall extension has a vertical length greater than a vertical length between a lower end of the vertical wall extension and the lower end of the brush.

17. The long rod grinding machine according to claim 4, wherein
the head includes
a head cover, and
an air guide attached to a lower portion of the head cover,
the vertical wall includes
a vertical wall base being a part of the head cover, and
a vertical wall extension being a part of the air guide or being the air guide, and
the vertical wall extension has a vertical length greater than a vertical length between a lower end of the vertical wall extension and the lower end of the brush.

18. The long rod grinding machine according to claim 1, wherein the multiple bristle bundles serve as passages for regulating airflow.

* * * * *